United States Patent [19]

Fornells

[11] 3,982,735

[45] Sept. 28, 1976

[54] DISMANTABLE AND DIRECTABLE RAIL OR BALUSTRADE

[76] Inventor: Gilbert P. Fornells, 38 rue Stendhal, 75020 Paris, France

[22] Filed: Nov. 21, 1973

[21] Appl. No.: 418,013

[30] Foreign Application Priority Data

Nov. 23, 1972 France ..... 72.41593

[52] U.S. Cl. ..... 256/59; 256/13.1

[51] Int. Cl.[2] ..... E04H 17/14

[58] Field of Search ..... 256/13.1, 59, 65–70, 256/21, 22, 24; 404/386, 388, 400; 52/758 H

[56] References Cited

UNITED STATES PATENTS

| | | | |
|---|---|---|---|
| 2,512,203 | 6/1950 | Fluharty | 256/59 UX |
| 2,944,797 | 7/1960 | Magness | 256/22 X |
| 3,131,871 | 5/1964 | Foulds | 256/13.1 |
| 3,239,070 | 3/1966 | Clauson | 256/59 X |
| 3,438,611 | 4/1969 | Giavotto et al. | 256/13.1 |
| 3,482,819 | 12/1969 | Leurent | 256/59 |
| 3,522,933 | 4/1970 | Braun | 256/22 |
| 3,591,144 | 7/1971 | Iving | 256/13.1 |
| 3,704,861 | 12/1972 | Glaesener | 256/13.1 |
| 3,825,229 | 7/1974 | Bartlett et al. | 256/59 |

FOREIGN PATENTS OR APPLICATIONS

| | | | |
|---|---|---|---|
| 222,161 | 7/1962 | Austria | 256/13.1 |
| 314,797 | 11/1969 | Sweden | 256/13.1 |

*Primary Examiner*—Dennis L. Taylor

*Attorney, Agent, or Firm*—John J. Byrne; Edward E. Dyson

[57] ABSTRACT

A balustrade of great length comprised of first elements secured to a series of posts along the path the balustrade is to follow, said elements having interengaging components with plastic rail members spanning the distance between posts and said rail members having their adjacent ends spaced from one another.

10 Claims, 22 Drawing Figures

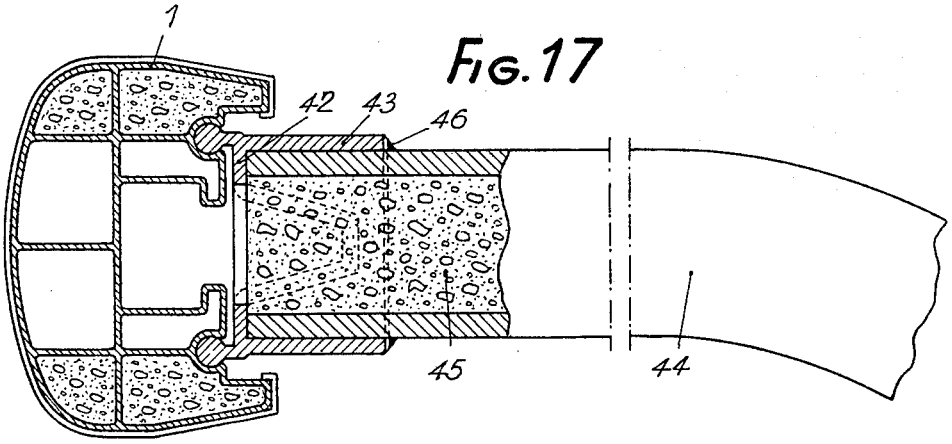
FIG. 17
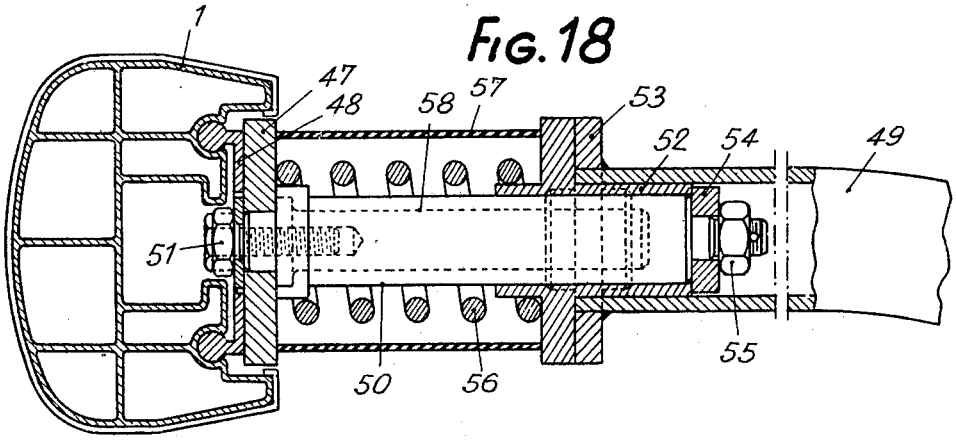
FIG. 18
FIG. 21
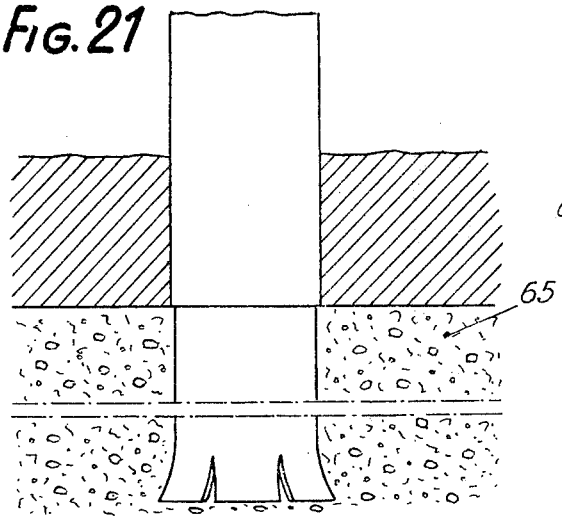
FIG. 22
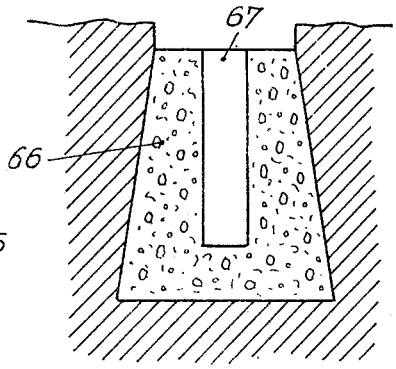

DISMANTABLE AND DIRECTABLE RAIL OR BALUSTRADE

The invention is directed toward a dismantable, directable rail or balustrade of plastic which is intended particularly but not exclusively for use on race-tracks. The balustrade of this invention may also be used in buildings, on ships (bulwarks), in car-parks, for enclosing sports fields, for the beaconing of air fields and roads and also for forming passageways.

It is known for rails or balustrades to be formed of wood or metal sections to be used particularly on race-tracks. Such rails or balustrades must necessarily possess a certain resistence to the tangential shocks which are often caused by one or more horses jostling or hugging the rail along the outer or inner lance during a race. Wooden rails or balustrades require expensive maintenance and may sometimes be damaged or scuffed.

Metal rails or balustrades entail numerous disadvantages. One of which is their weight which entails handling problems. The different elements of metal rails are generally of great length and consequently difficult to move or transport. Furthermore, their dismantaling or re-assembly takes time and considerable labor. The connection joints of metal rails sometimes develop dangerous projections. Metal rails or balustrades are expensive to maintain. One of the objectives of this invention is to obviate the disadvantages mentioned above by providing a dismantable, directable rail or balustrade of plastics material which has sufficient impact strength and perfect elasticity while its low weight permits easy maintenance and its dismantling and re-assembly requires the minimum labor, the assembly of the component elements of this rail being effected without tools of any kind.

The invention is embodied, as a new industrial product, in the form of a dismantable, directable rail or balustrade of plastics material which comprises connection elements associated with supporting posts distributed equidistantly or otherwise on a predetermined rectilinear or curved path, these connecting elements making it possible to place in position in a detachable manner, by interlocking, compartmented sections of great length which constitute the actual rail or balustrade and between which there is provided, in positions corresponding to each connecting element, a space permitting the free expansion of the sections, this space being covered by a covering effecting the continuity of the rail or balustrade.

According to another objective of the invention, the supporting posts distributed equidistantly or otherwise on a predetermined rectilinear or curved path are attached to a plate on which are detachably fixed the connecting elements enabling compartmented sections of great length to be placed removably in position by interlocking.

Another objective of the invention is to provide connecting elements detachably fixed on supporting posts which are composed of plastic plates provided with projections cooperating with interengaging grooves provided in the compartmented sections of great length which constitute the actual rail or balustrade.

According to another objective of the invention the supporting posts are constituted by tubular elements of plastics material which are intended to engage over metal elements of standard dimension.

According to another objective of the invention two opposite connecting elements are provided to enable two opposite sections of great length to be detachably placed in position by interlocking to form a double parallel rail or balustrade.

Another objective of the invention is to provide the connecting elements having opposite projections permitting the detachable positioning by interlocking of two opposite sections of great length to form a double parallel rail or balustrade.

According to another objective of the invention, compartmented sections of great length constituting the actual rail or balustrade are partially or completely provided with an internal lining of expanded plastic foam which increases their impact and crushing strength.

According to one embodiment of the invention the supporting posts are each detachably associated with a bent arm fastened to a guide element on which is slidably engaged one of the ends of a section of great length. The guide element is connected to a reinforcing web having a covering lip on which is articulated a second, hollowed guide element slidably engaged on the opposite end of the section of great length juxtaposed against the first section.

According to another embodiment of the invention, each section of great length has two internal parallel grooves provided one on each side of its transversal axis and cooperating with hollowed projections provided on the guide elements.

According to one embodiment of the invention a cam is provided with two diametrically opposite bosses and operated from the outside by means of an operating handle cooperating with the first guide element to effect the locking in position of each section of great length after it has been slidably engaged over the guide element.

According to another embodiment of the invention, a hollowed metal reinforcing element is engaged in the middle portion of each section, either at each of its ends in positions corresponding to each connecting element, or in any position on the said element, or over its entire length in order to impart increased strength to the sections while offering resistance to their disengagement or detachment.

According to another embodiment of the invention, the hollowed metal reinforcing element is associated with two fittings detachably fastened to the plate and to the connecting element by screws or bolts.

According to another embodiment of the invention, the connecting elements of plastic material are provided with an integrally cast tubular extension intended to fit over the top end of the supporting post, which is made entirely of plastics material, this tubular extension being fastened to the supporting post by adhesive bonding or welding.

According to another embodiment of the invention, a shock absorber device is interposed between the plate carrying the connecting element and the supporting post, this device comprising a deformable sleeve associated with an elastic return means disposed between the plate and the supporting post, and sliding guide elements carried by the plate.

These and other objects of the invention will become more apparent to those skilled in the art by reference to the following detailed description when viewed in light of the accompanying drawings wherein:

FIG. 17 illustrates an alternative arrangement for joining the connecting element to the supporting post;

FIG. 18 shows a telescopic device interposed between the connecting element and the supporting post to permit the absorption of shocks to which the rail or balustrade is subjected;

FIG. 21 is a sectional view illustrating anchoring a supporting post in a concrete bed; and FIG. 22 is a sectional view illustrating a supporting post on a concrete base embedded in the ground.

Figure 1:
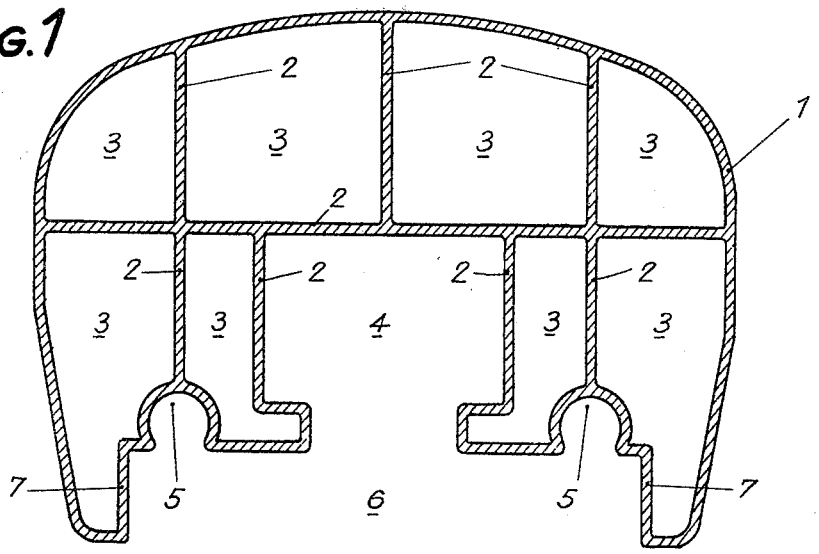
FIG. 1 is a cross-section view of a compartmented member forming the actual rail or balustrade of this invention.

Referring now to the drawings wherein like elements are referred to by like numerals, FIG. 1 is a cross-section of a elongated member of the type forming the actual rail or balustrade of this invention. The member is made of a plastic material, such as polyvinyl chloride. The section 1 is provided with multiple partitioning 2 forming a series of compartments 3, of which one 4 situated in the middle portion of the section opens out to the outside. Two grooves or slots 5 provided one on each side of the compartment 4 opens out into a cavity 6 bounded by two side walls 7.

Figure 2:
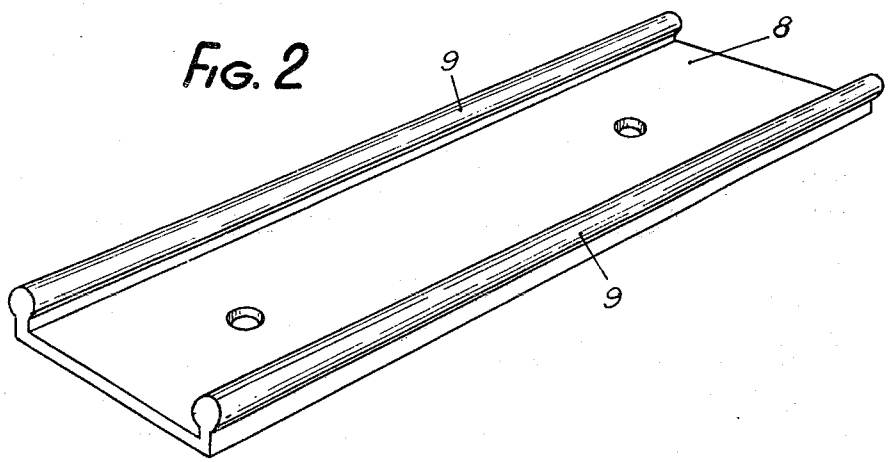
FIG. 2 is a perspective view of a connecting element of plastic material.

The connecting element made of plastic material which is shown in FIG. 2 is composed of a plate 8 provided with projections 9 intended to cooperate with the grooves 5 provided in the sections 1.

Figure 3:
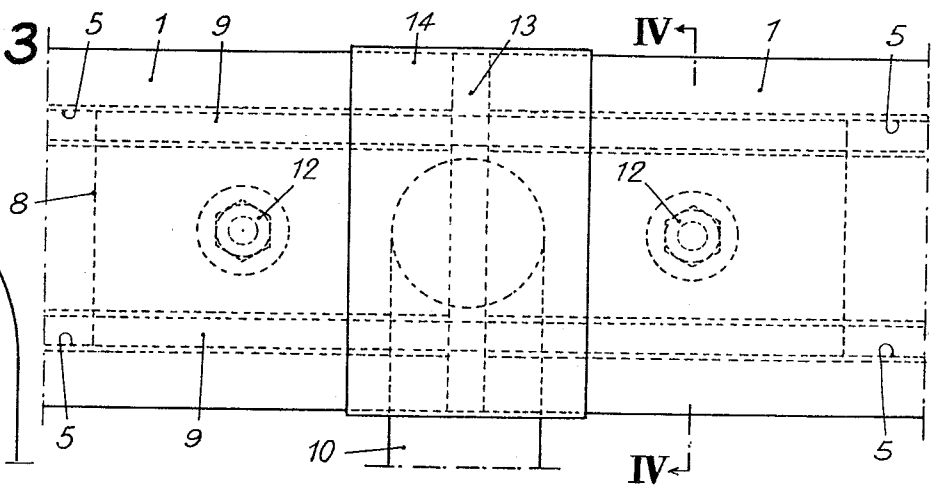
FIG. 3 is a front elevational view showing two compartmented sections joined by interlocking with a connecting element.
Figure 4:
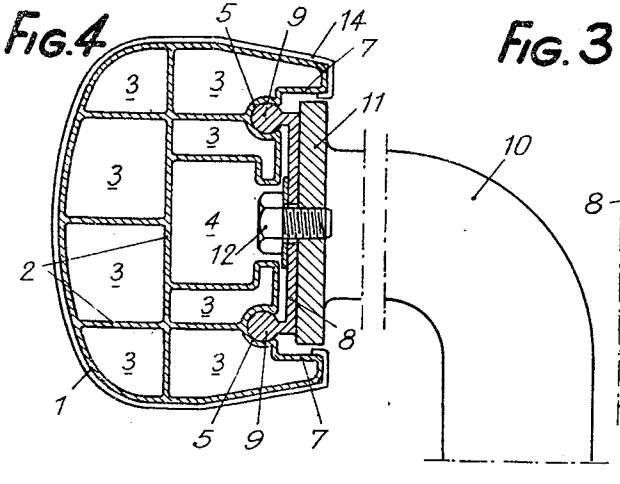
FIG. 4 is a view in cross-section on the line IV—IV in FIG. 3.

The rail or balustrade is composed, as illustrated in FIGS. 3 and 4, of a series of supporting posts 10, for example of swan-neck shape, preferably composed of tubular elements of plastic material which are engaged over metal elements of standardized dimensions anchored in the ground, either detachably or non-detachably, these tubular elements being fastened to a plate 11 on which the connecting element 8 is detachably fastened with the aid of bolts 12. The sections 1 are placed in position by interlocking, the projections 9 engaging by force, at this moment, in the grooves 5 in the sections as illustrated in FIG. 4.

Figure 5:
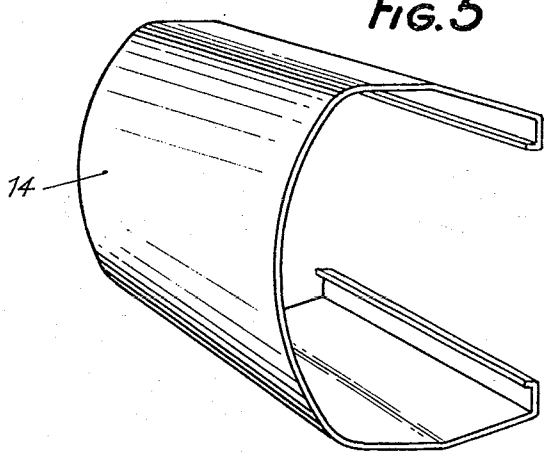
FIG. 5 is a view in perspective of a joint cover.

In order to permit free expansion of the sections 1, when they are placed in position, there is formed between two of them, in positions corresponding to the connecting element 8, a space 13 (see FIG. 3) which is covered by a joint cover 14, such as that shown in perspective in FIG. 5, this joint cover forming a continuous rail.

Figure 6:
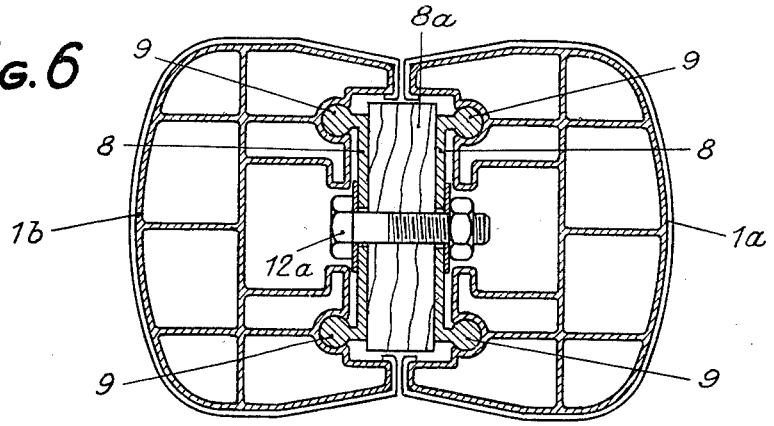
FIGS. 6, 7 and 8 show three forms of assembly of a double parallel rail or balustrade.
Figure 7:
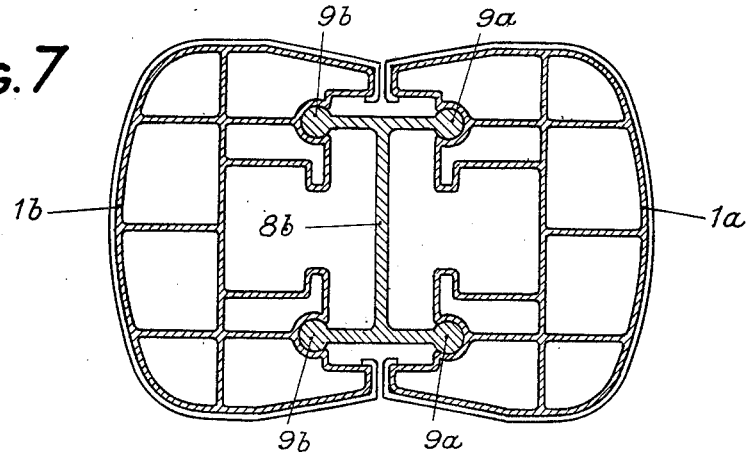
Figure 8:
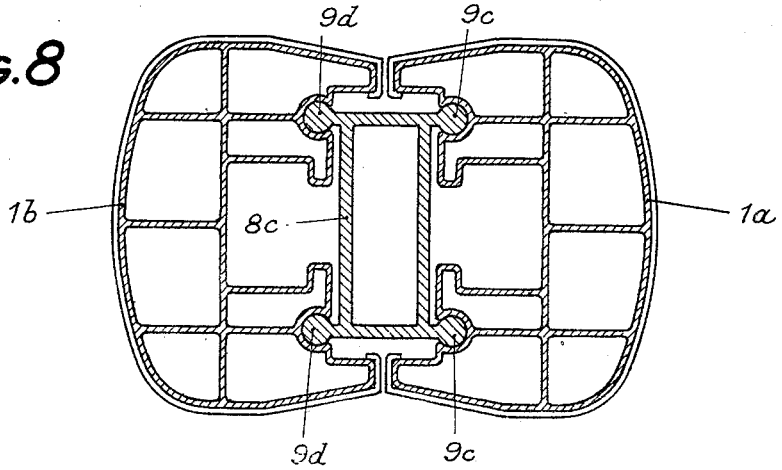

FIGS. 6, 7 and 8 illustrate three forms of assembly permitting the formation of a double parallel rail or balustrade.

In FIG. 6 it is seen that this first form of assembly is achieved with the aid of two opposite connecting elements provided with projections enabling two opposite sections 1*a* and 1*b* to be detachably placed in position by interlocking the two connecting elements being joined together by means of an intermediate part 8*a* and a bolt 12*a*.

FIG. 7 shows a second form of assembly in which the connecting element 8*b* has in cross-section the shape of a double T the horizontal branches of which are provided at their ends with opposite projections 9*a* and 9*b* permitting the detachable positioning, by interlocking, of two opposite sections 1*a* and 1*b*.

FIG. 8 shows a third form of assembly, according to which the connecting element 8*c*, which is hollow, is provided with opposite projections 9*c* and 9*d* which also enable two opposite sections 1*a* and 1*b* to be detachably positioned by interlocking.

Figure 9:
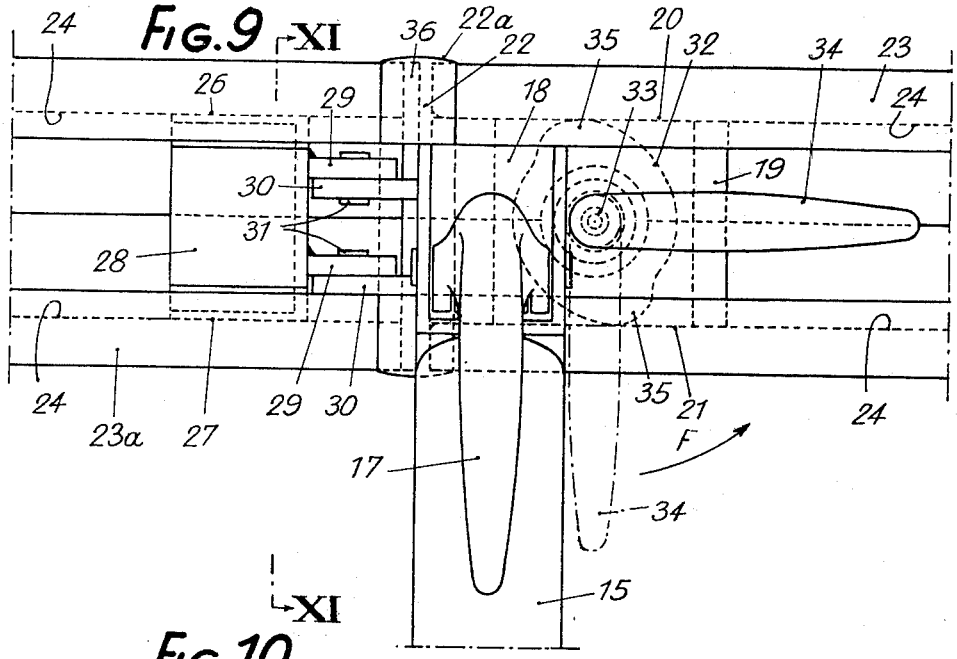
FIG. 9 is a rear elevational view of a rail or balustrade provided with its mounting device in the locked position.
Figure 10:
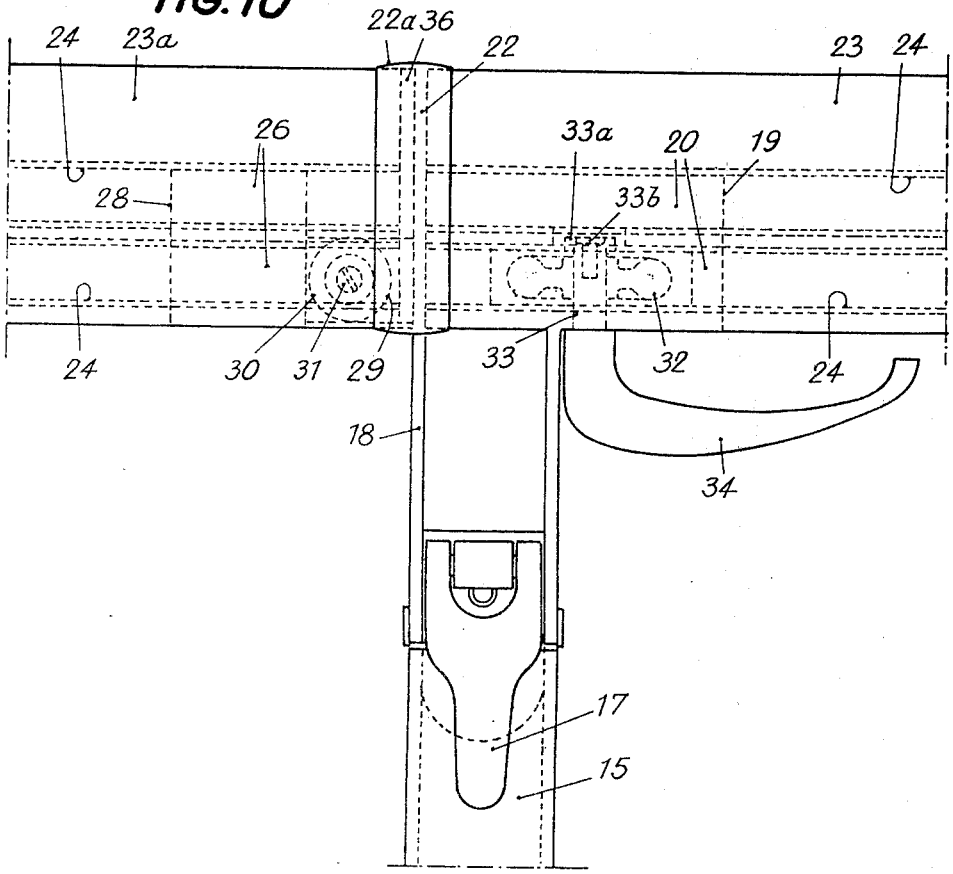
FIG. 10 is a plan view of the elements of FIG. 9.
Figure 11:
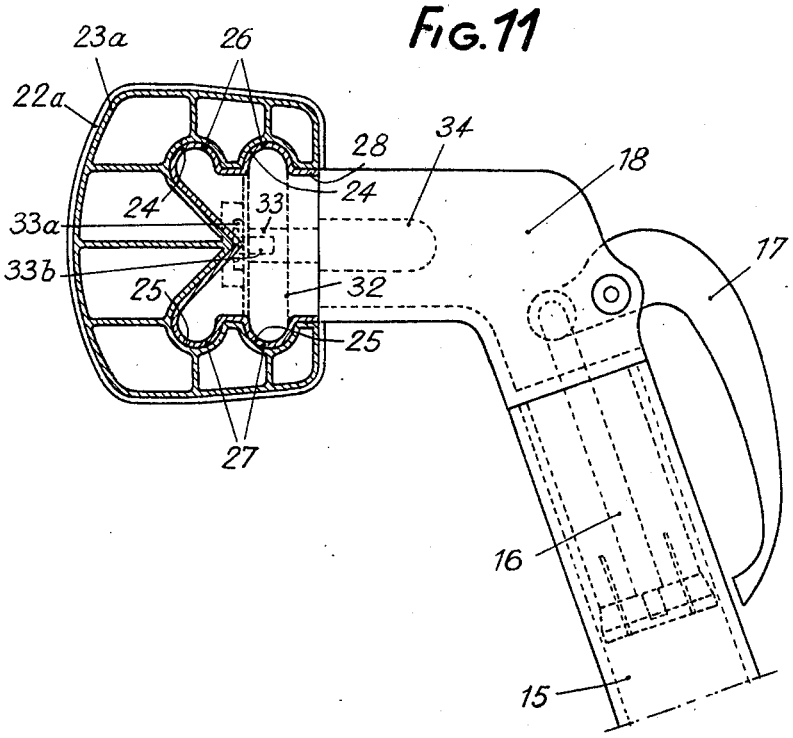
FIG. 11 is a view in cross-section on line XI—XI in FIG. 9.

FIGS. 9, 10 and 11 illustrate another rail or balustrade having a device for locking in position the sections of great length which form this rail or balustrade. In this embodiment each supporting post 15 is provided with a bent arm 18 detachably connected thereto by means such as 16 operated by a lever 17. A guide element 19 which is provided with hollow projections 20 and 21 and connect to a reinforcing web 22 provided with a covering lip 22*a* (see FIG. 9) is secured to bent arm 18.

On each side of its transverse axis, each section 23 has two opposite internal parallel grooves 24 and 25 (see FIG. 11), which permit the engagement by sliding of one of the ends of the section 23 over the hollow projections 20 and 21 of the guide element 19, the other end of the identical section 23*a*, which is juxtaposed against the section 23, likewise being engaged by sliding with the aid of its identical opposite internal parallel grooves 24 and 25 over the hollow projections 26 and 27 of a second guide element 28 articulated by means of lugs 29 carried by this guide element and of lugs 30 carried by the reinforcing web 22, the lugs being connected by pins 31.

This double articulation makes it possible to impart to the paired end of each section an angular movement of slight amplitude in a horizontal plane when the assembly comprising the rail or balustrade is installed in curved portions of the track.

The device which is used for locking and positioning sections of great length constituting the actual rail or balustrade and which is associated with this embodiment is composed of a cam 32 mounted at the end of a pin 33 with the aid of a washer 33*a* and a screw 33*b*, the pin 33 being connected to a handle 34 operated from the outside. The cam 32 has two diametrically opposite bosses 35 intened to cooperate with the cavities of the projections 20 of the guide element 19.

Figure 12:
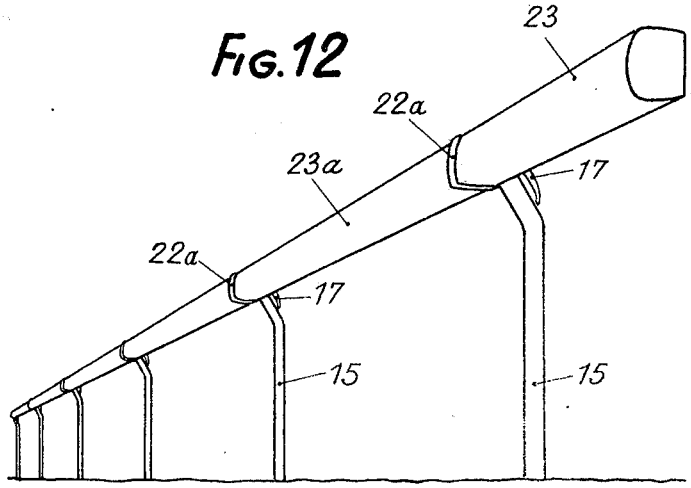
FIG. 12 is a perspective view of a rail or balustrade provided with the locking device shown in FIGS. 9, 10, and 11.

In order to effect the assembly of a rail constructed as illustrated in FIGS. 9, 10 and 11 the bent arm 18 carrying the guide elements 19 and 28 and the web 22 is jointed to the post 15, and then the first section 23 is engaged by sliding over the guide element 19, to form the beginning of the rail which can be seen on the right-hand side in FIG. 9, until its left-hand end comes into contact with the reinforcing web 22 (see FIG. 9). The operating handle 34 is then operated in the direction of the arrow F so as to bring this handle from the position shown in dot-and-dash lines in FIG. 9 into the position shown in solid lines. The bosses 35 will then engage in the cavities of the projections 20 and 21 of the guide element 19 and effect the locking in position of the section 23. The right-hand end of the second section 23*a* is then engaged, once again by sliding, over the second guide element 28, forming between it and the reinforcing web 22 a space 36 permitting the free expansion of each section (see FIG. 9). The same successive operations are repeated in order to obtain a continuous rail, as illustrated in FIG. 12.

Figure 13:
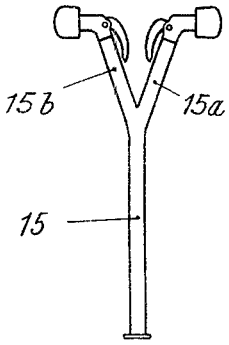
FIG. 13 is a side view of a double rail provided with the same locking device.

There is illustrated in FIG. 13 a double rail constructed in the manner described above, the supporting post 15 having at the top two V-shaped branches 15*a* and 15*b*.

Figure 14:
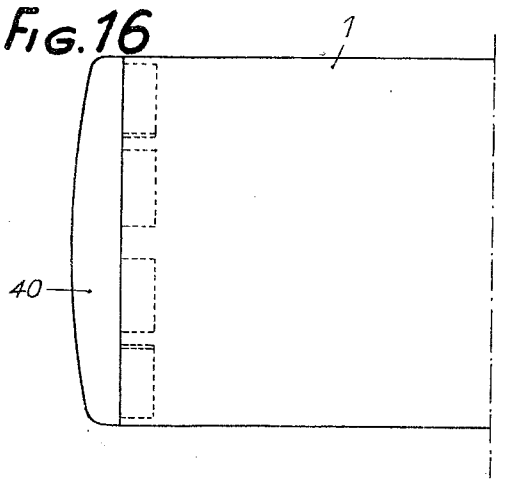
FIG. 14 is a view in longitudinal section on the line XIV—XIV in FIG. 15, showing the metal reinforcing element engaged in two sections of great length at the point where they are juxtaposed.
Figure 14:
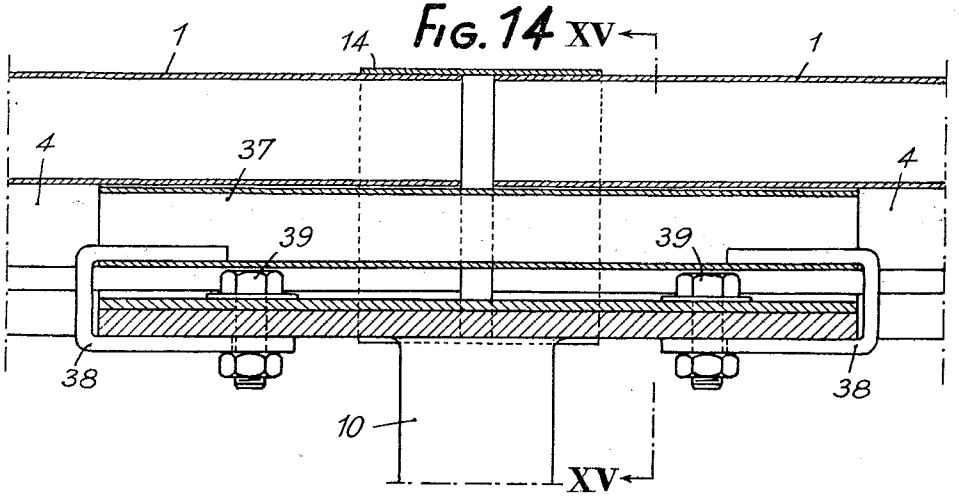

In order to give the sections of great length 1, such as those illustrated in FIGS. 1, 2 and 3, increased resistance to tearing-away and to disengagement, a hollow metal reinforcing element 37 is engated in the middle portion 4 of these sections when the rail is assembled, this element 37 being held by two fittings 38 detachably fastened to the connecting element 8 and to the plate 11 by means of bolts 39 (see FIG. 14).

The metal reinforcing element may be engaged in the middle portion 4 of the section in any position or even over its entire length.

Figure 15:
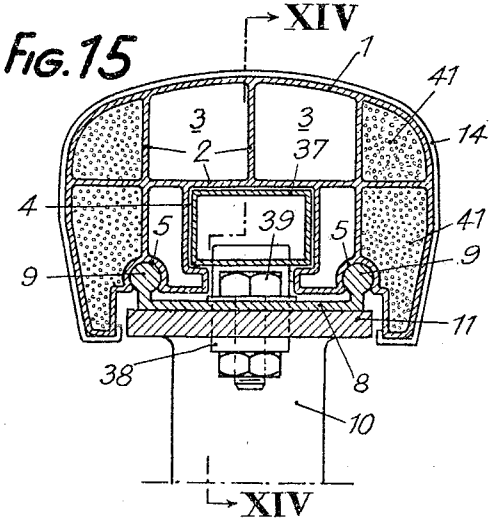
FIG. 15 is a view in cross-section on the line XV—XV in FIG. 14.

FIG. 15 illustrates the possibility of providing the compartments 3 of the sections 1 with an internal lining 41 of expanded plastics foam, which lining may be partial as illustrated in FIG. 12, or complete in which case all the compartments 3 are provided with this lining 41, thereby imparting to the sections greater resistance to impact and crushing, for example during a horse race.

It is therefore seen that there are three possible forms of reinforcement of the sections of great length constituting the rail or balustrade.

Figure 16:
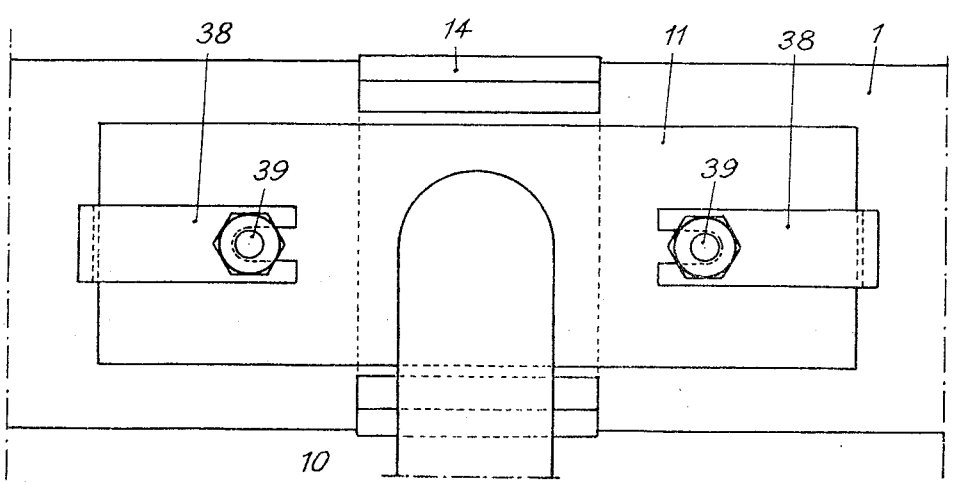
FIG. 16 is a rear view in elevation corresponding to FIG. 14.

There is shown in FIG. 16 an end plug 40 of plastics material which is fitted at each end on completion of the operation of assembling the rail.

In the modified embodiment illustrated in FIG. 17, the sections 1 are joined by interlocking with connecting elements 42 of plastics material, which are provided with an integrally cast tubular extension 43 intended to fit over the top end of a tubular supporting post 44 made entirely of plastic material and optionally provided with a lining of expanded plastics material 45.

The tubular extension 43 is fastened to the tubular supporting post 44 by adhesive bonding or welding 46.

FIG. 18 illustrates a shock absorber device which can be fitted to the rail of the kind illustrated in FIGS. 3 and 4, and which is interposed between the plate 47 carrying the connecting element 48 and the tubular supporting post 49.

This device comprises a cylindrical rod 50 connected by means of a bolt 51 to the plate 47, its other end sliding in a sleeve 52 engaged in the post 49 and fastened to a flange 53 connected to the post. A thrust washer 54 is fastened to the end of the sliding rod 50 with the aid of a nut 55 which normally bears against the end of the sleeve 52 which is engaged in the post 49, in order to enable the rail to resume its normal position, immediately after a shock, through the action of a coil spring 56 disposed between the plate 47 and the sleeve 52 and associated with a deformable protective sleeve 57, guide rods 58 carried by the plate 47 being mounted for sliding in the flange 53 on each side of the assembly composed of the rod 50, the coil spring 56 and the deformable sleeve 57.

Figure 19:
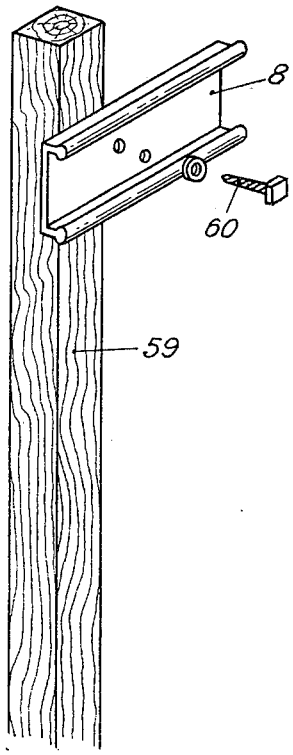
FIG. 19 is a perspective view of a detachable connecting element on an ordinary wooden supporting post.

FIG. 19 shows in perspective a detachable form of fastening of a connecting element 9 on an ordinary wooden supporting post 59, by means of screws 60.

Figure 20:
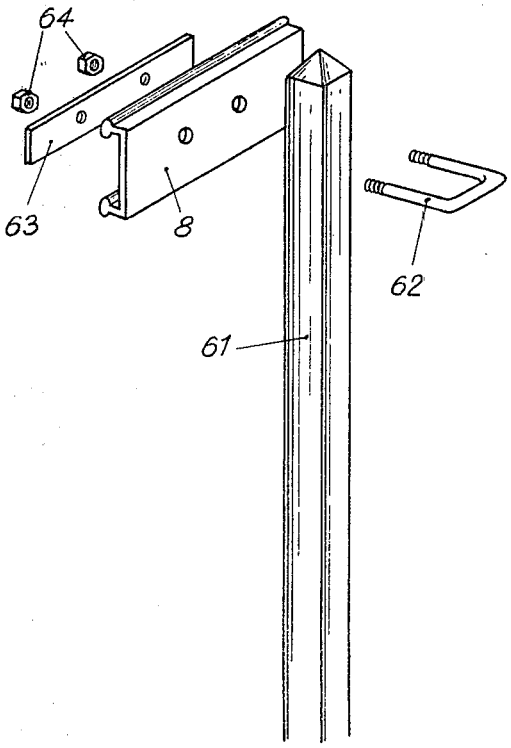
FIG. 20 is a perspective view of detachable fastening connecting element on a concrete supporting post.

FIG. 20 shows in perspective another method of detachable fastening of the same connecting element 8 on a concrete post 61 with the aid of a threaded stirrup 62 surrounding the post, with the addition of a metal plate 63 which bears against the element 8 and against which bear fastening units 64.

FIG. 21 illustrates a method of anchoring supporting posts, used for mounting the rail or balustrade, in a concrete bed 65.

FIG. 22 illustrates another method of positioning supporting posts which comprises providing concrete bases 66 with a central opening 67 to receive an upright on which each tubular post is engaged.

Because of the light weight of its component elements the rail or balustrade of this invention can be shifted on a race course in accordance with the state of the ground. For example after a race, sites provided in advance to permit the positioning of the detachable supporting posts makes it possible for the original position of the rail to be changed.

The structure of the sections of great length makes it possible in complete safety for electric cables to be accommodated inside the sections, since there is practically no risk of the latter being detached.

In a general manner, while there has been disclosed effective and efficient embodiments of the invention, it should be well understood that the invention is not limited to such embodiments as there might be changes in the arrangement, disposition, and form of the parts without departing from the principle of the present invention as comprehended within the scope of the accompanying claims.

I claim:

1. A dismantable elongated rail assembly comprising a rail for attachment to a series of supporting elements spaced from each other, mounting means secured to each of said elements, a rail extending between said elements each having first and second ends, interengaging means on said mounting means and said rail for securing successive rails to said mounting means, said interengaging means comprising at least a pair of spaced projections on said mounting means, spaced grooves in said rail for mating with said projections and said projections being snapfitted into said grooves.

2. The rail of claim 1 wherein a gap is defined between the first end of one rail and the second end of another successive rail secured to said mounting means, and including a cover for concealing said gap.

3. The rail of claim 2 wherein said cover is snug fitted over said rail.

4. The rail of claim 1 wherein said mounting means includes mounting plates attached to said elements, said mounting plates being comprised of plastic.

5. The rail of claim 1 having a second mounting plate affixed to the opposite side of said first plate to also receive a rail to thereby form a double rail assembly.

6. The rail of claim 1 wherein said projection and said groove are circular in cross section, with said groove being defined by inner wall portions of said rail, said wall portions snugly engaging said projection.

7. The rail of claim 1 wherein said rail is of a plastic material.

8. The rail of claim 1 wherein said reinforcing means are plural webs extending longitudinally of said rail and transversely of each other.

9. The rail of claim 8 wherein said rail is of a plastic material and said webs are formed integrally therewith.

10. The rail of claim 9 wherein webs divide said rail into a series of compartments and said compartments are filled with an expanded plastic.

* * * * *